US008574137B2

(12) United States Patent
Chen et al.

(10) Patent No.: US 8,574,137 B2
(45) Date of Patent: Nov. 5, 2013

(54) UPPER LIMB TRAINING DEVICE

(75) Inventors: Dar-Zen Chen, Taipei (TW); Shu-Yi Wang, Taipei (TW); Tzong-Ming Wu, Taipei (TW)

(73) Assignee: National Taiwan University, Taipei (TW)

( * ) Notice: Subject to any disclaimer, the term of this patent is extended or adjusted under 35 U.S.C. 154(b) by 469 days.

(21) Appl. No.: 12/985,428

(22) Filed: Jan. 6, 2011

(65) Prior Publication Data

US 2012/0040807 A1 Feb. 16, 2012

(30) Foreign Application Priority Data

Aug. 16, 2010 (TW) ..... 99127328 A

(51) Int. Cl.
*A63B 21/02* (2006.01)
*A61H 1/02* (2006.01)

(52) U.S. Cl.
USPC ..... 482/121; 482/124; 128/898; 601/33

(58) Field of Classification Search
USPC ..... 482/51, 121, 122–124; 601/5, 33; 128/898
See application file for complete search history.

(56) References Cited

U.S. PATENT DOCUMENTS 3,683,897 A * 8/1972 Shield et al. ..... 601/34
3,976,057 A * 8/1976 Barclay ..... 601/34
4,237,873 A * 12/1980 Terry et al. ..... 602/20
4,772,015 A * 9/1988 Carlson et al. ..... 482/92
5,547,464 A * 8/1996 Luttrell et al. ..... 602/26
5,865,714 A * 2/1999 Marlowe ..... 482/112
6,394,937 B1 * 5/2002 Voris ..... 482/139
7,048,704 B2 * 5/2006 Sieller et al. ..... 602/16
7,222,826 B1 * 5/2007 Berglund ..... 248/188.1
7,235,038 B2 * 6/2007 Liao ..... 482/44
7,507,215 B2 * 3/2009 Ryan ..... 602/23
7,601,187 B2 * 10/2009 Webber et al. ..... 48/72
7,670,269 B2 * 3/2010 Webber et al. ..... 482/94
7,931,609 B2 * 4/2011 Blanchard ..... 602/21
8,425,436 B2 * 4/2013 Sankai ..... 601/5

* cited by examiner

*Primary Examiner* — Stephen Crow

(74) *Attorney, Agent, or Firm* — Alan Kamrath; Kamrath IP Lawfim, P.A.

(57) ABSTRACT

An upper limb training device includes a first rod, a second rod, a third rod, a first resilient element, and a second resilient element. The second rod is pivoted to the first rod by a first revolution element. The third rod is pivoted to the second rod by a second revolution element. Two ends of the first resilient element respectively connect with the first rod and the third rod for providing resistance when the first rod and the second rod rotate relative to the third rod. Two ends of the second resilient element respectively connect with the first rod and the third rod for providing resistance when the first rod rotates relative to the second rod. The first revolution element is disposed between two connecting points at which the first resilient element and the second resilient element connect with the first rod.

16 Claims, 5 Drawing Sheets

UPPER LIMB TRAINING DEVICE

BACKGROUND OF THE INVENTION

1. Field of the Invention

The present invention relates to an upper limb training device and, specifically, to an upper limb training device for exercise with multiple degrees of freedom of an upper limb, which is compact and easy to carry.

2. Description of the Related Art

Most conventional training devices use weights such as weight stacks combined with a training structure to provide resistance, to accomplish a goal of training. As the desired resistance increases, inertia forces also increases. This may cause sports injury if a user incautiously uses the training devices improperly. The minimum resistance value that this kind of training device provides is still too large for a patient who has trouble with muscle degeneration. In this case, the patient's goal of training cannot be accomplished, or the use of this kind of training device may cause other injury. The prior arts, such as U.S. Pat. No. 6,394,937, U.S. Pat. No. 7,601,187, and U.S. Pat. No. 7,670,269 all use elements such as weight stacks to provide resistance during training.

For example, in U.S. Pat. No. 6,394,937, a pulley system is used coupled to a handle portion of the device and weights such as weight stacks. When the user exercises by manipulating the handle portion, the weight stack provides resistance to exercise, to magnify the effect of exercise. The design of the structure or the process of adjusting resistance of this kind of device, however, is complicated. It is difficult for the user to select an optimal resistance value and adjust a resistance value to the optimal one during the exercise process.

Moreover, in prior arts, most muscle training devices only provide movements on a single plane or for a specific muscle group, and the devices are bulky. If the user wants to use a single training device to do exercise on multiple planes or for multiple muscle groups, he/she has to change components and assemble the device often. This takes time and energy. In addition, the user can only go to a place which has this kind of training device at a specific time to exercise, which makes the training more difficult and limited.

For example, U.S. Pat. No. 7,235,038 discloses a design specifically for elbow training in structure. Protectors able to rotate relative to one another are used and cooperate with resilient elements for providing resistance for exercise, such that the goal of building the user's arm is accomplished. However, the design is for exercising a single muscle group. If the user wants to exercise other muscle groups, he/she has to use other training devices corresponding to other muscle groups. This can be troublesome.

In U.S. Pat. No. 4,772,015, a rod is pivotally connected with a resistance member. A user exercises his/her arm by grasping a hand grip assembly of the rod, and the resistance member is used to provide resistance when exercise is performed, such that the goal of building his/her arm is accomplished. However, due to the limit of the structure of the device, when the user wants to exercise his/her shoulder with multiple degrees of freedom, he or she has to adjust the position of the resistance member and to move the position of the whole device. This is inconvenient for use.

Therefore, it is desirable to provide an upper limb training device able to perform an arm exercise with multiple degrees of freedom with a single device. Also, the device has to allow for exercise or physical therapy anytime and to prevent injury that inertia forces may cause. Moreover, the device has to be easy to adjust and carry, and its use is not limited by space and place, to mitigate and/or obviate the aforementioned problems.

SUMMARY OF THE INVENTION

It is a main object of the present invention to provide an upper limb training device for exercise with multiple degrees of freedom and for different muscle groups of an upper limb.

In order to achieve the above and other objects, an upper limb training device of the present invention comprises at least one first rod, at least one second rod, at least one third rod, at least one first resilient element, and at least one second resilient element. The at least one second rod is pivoted to the at least one first rod by a first revolution element, such that the at least one first rod is able to rotate relative to the at least one second rod. The at least one third rod is pivoted to the at least one second rod by a second revolution element, such that the at least one second rod is able to rotate relative to the at least one third rod. Two ends of the at least one first resilient element respectively connect with the at least one first rod and the at least one third rod for providing resistance when the at least one first rod and the at least one second rod rotate relative to the at least one third rod. Two ends of the at least one second resilient element respectively connect with the at least one first rod and the at least one third rod for providing resistance when the at least one first rod rotates relative to the at least one second rod. The first revolution element is disposed between two connecting points at which the at least one first resilient element and the at least one second resilient element connect with the at least one first rod. A rotation axis of the first revolution element and a rotation axis of the second revolution element are substantially parallel and are on the same plane.

The upper limb training device of the present invention further comprises at least one fourth rod and at least one third resilient element. The at least one fourth rod is pivoted to the at least one third rod by a third revolution element, such that the at least one third rod is able to rotate relative to the at least one fourth rod. Two ends of the at least one third resilient element respectively connect with the at least one third rod and the at least one fourth rod for providing resistance when the at least one third rod rotates relative to the at least one fourth rod. A rotation axis of the second revolution element and a rotation axis of the third revolution element are substantially perpendicular to one another and intersect.

The upper limb training device of the present invention further comprises a supporting arm. The supporting arm is pivoted to the at least one fourth rod by a fourth revolution element such that the fourth revolution element is able to rotate relative to the supporting arm. A rotation axis of the fourth revolution element is substantially perpendicular to ground.

The upper limb training device of the present invention adjusts the magnitude of resistance provided by the resilient elements by changing the position of the connecting points at which the resilient elements connect with the rods. Thus, it is able to train muscle groups of the upper limb with adjustable resistance.

The upper limb training device of the present invention provides the upper limb exercise with multiple degrees of freedom to train different portions of the muscle groups. Also, it is easy to adjust the resistance. Moreover, the upper limb training device of the present invention combines a plurality of rods, revolution elements, and resilient elements. This greatly simplifies the structure of the device and decreases the volume of the device, and it is easier for the user to carry or to use.

DETAILED DESCRIPTION OF THE PREFERRED

The advantages and innovative features of the invention will become more apparent from the following detailed description when taken in conjunction with the accompanying drawings.

An upper limb training device of the present invention comprises a plurality of rods, a plurality of revolution elements, and a plurality of resilient elements. Adjacent different rods connect with each other through a revolution element (such as a pivot element). Each resilient element provides resistance when the rods rotate relatively and maintaining a mass balance of the whole device. In the present invention, rods used for different portions may be a single rod or a combination of a plurality of rods (such as a parallel-rod structure), and the same for resilient elements used for different portions. The following paragraphs describe an embodiment of the upper limb training device of the present invention. For convenience' sake, in this embodiment, each rod and each resilient element is represented by a single element. However, the number and the performing way of the elements of the aforementioned upper limb training device of the present invention are not limited to this embodiment.

Figure 1:
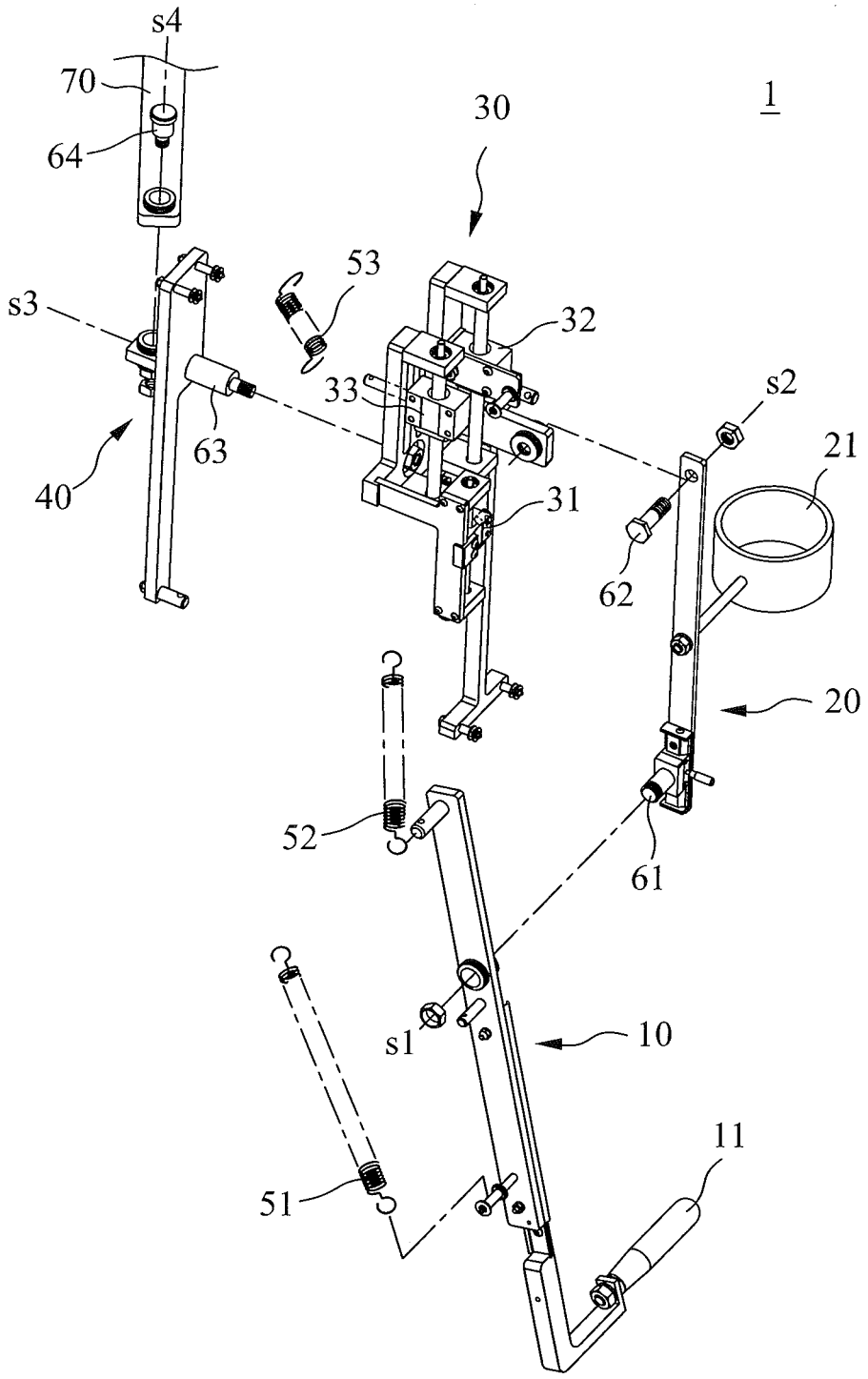
FIG. 1 is an exploded view of the structure of an embodiment of an upper limb training device of the present invention.
Figure 2:
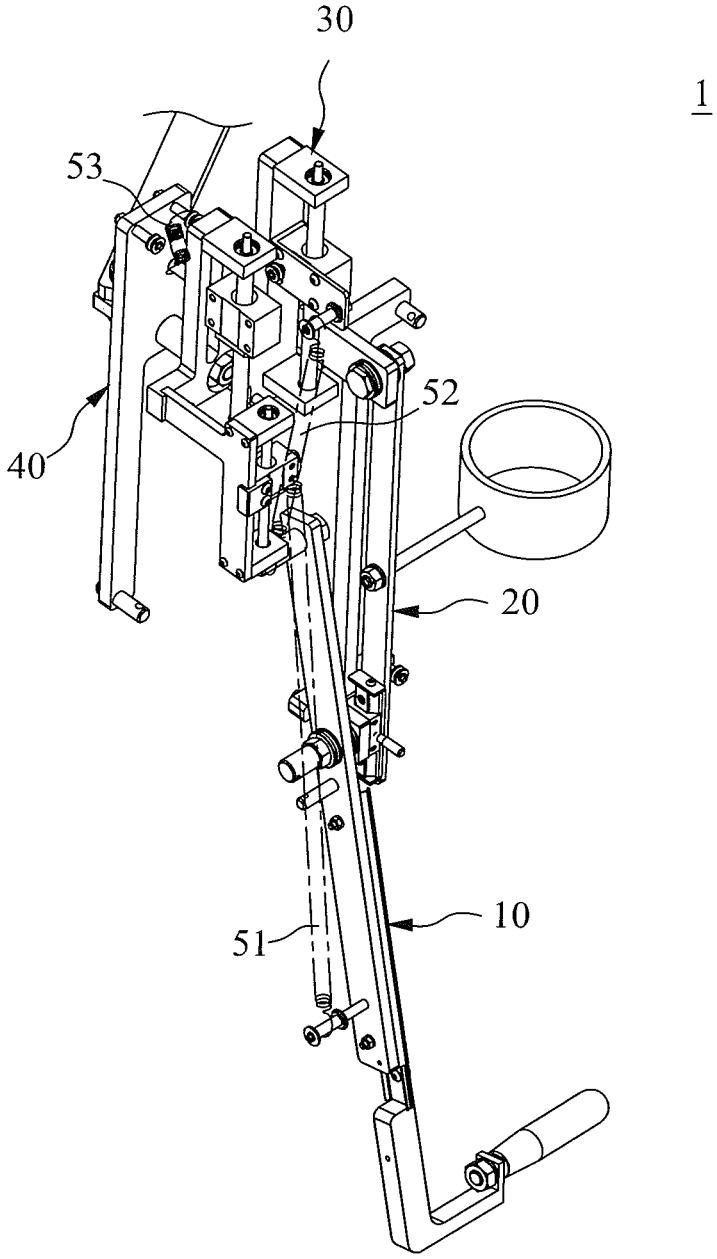
FIG. 2 is a perspective view of an embodiment of the upper limb training device of the present invention.

Please refer to FIG. 1 and FIG. 2 first for the following paragraphs. FIG. 1 is an exploded view of the structure of an embodiment of the upper limb training device 1 of the present invention. FIG. 2 is a perspective view of an embodiment of the upper limb training device 1 of the present invention. As shown in FIG. 1 and FIG. 2, the upper limb training device 1 of the present invention comprises a first assembly or rod 10, a second assembly or rod 20, a third assembly or rod 30, a first resilient element 51, and a second resilient element 52. The second rod 20 is pivoted to the first rod 10 by a first revolution element 61 such that the first rod 10 is able to rotate relative to the second rod 20. The third rod 30 is pivoted to the second rod 20 by a second revolution element 62, such that the second rod 20 is able to rotate relative to the third rod 30. A rotation axis s1 of the first revolution element 61 and a rotation axis s2 of the second revolution element 62 are substantially parallel and are on the same plane.

Two ends of the first resilient element 51 respectively connect with the first rod 10 and the third rod 30 for providing resistance when rotation of the first rod 10 relative to the third rod 30 causes the second rod 20 to rotate relative to the third rod 30. Two ends of the second resilient element 52 respectively connect with the first rod 10 and the third rod 30 for providing resistance when the first rod 10 rotates relative to the second rod 20. The first revolution element 61 is disposed between two connecting points at which the first resilient, two connecting points at which the first resilient element 51 and the second resilient element 52 connect with the first rod 10 are respectively disposed on both sides of the first revolution element 61. With the above structure, the first resilient element 51 and the second resilient element 52 provide different resistance to the movement of the aforementioned first rod 10 in different directions. In this embodiment, each resilient element may be a spring or other component that has a similar function.

The aforementioned first rod 10 comprises a handle portion 11. A user grasps the handle portion 11 to manipulate the upper limb training device 1 of the present invention to exercise his/her upper limb with multiple degrees of freedom. The second rod 20 further comprises a fastening element 21. The fastening element 21 connects the second rod 20 to the user's arm portion and makes the second rod 20 substantially parallel to the arm. This improves the convenience of putting on or manipulating the upper limb training device 1 of the present invention.

The upper limb training device 1 of the present invention further comprises a fourth rod 40 and a third resilient element 53. The fourth rod 40 is pivoted to the third rod 30 by a third revolution element 63, such that the third rod 30 is able to rotate relative to the fourth rod 40. Two ends of the third resilient element 53 respectively connect with the third rod 30 and the fourth rod 40 for providing resistance when the third rod 30 rotates relative to the fourth rod 40. The rotation axis s2 of the second revolution element 62 and a rotation axis s3 of the third revolution element 63 are substantially perpendicular to one another and intersect.

The upper limb training device 1 of the present invention uses the first resilient element 51, the second resilient element 52, and the third resilient element 53 to maintain a mass balance of the first rod 10, the second rod 20, the third rod 30, and the fourth rod 40 and to maintain the stability of the device.

Changing the position of the connecting point at which each resilient element connects with the corresponding rods changes the magnitude of the resistance provided by each resilient element. For example, changing the position of the connecting point at which the first resilient element 51 (or the second resilient element 52) connects with the first rod 10 or the third rod 30 changes the displacement of the first resilient element 51 (or the second resilient element 52), so that the magnitude of resistance provided by the first resilient element 51 (or the second resilient element 52) is adjusted. Similarly, changing the position of the connecting point at which the third resilient element 53 connects with the third rod 30 or the fourth rod 40 changes the magnitude of resistance provided by the third resilient element 53.

In order to facilitate changing the position of the connecting points of the resilient elements 51, 52, 53 to adjust the magnitude of the resistance, in one embodiment of the present invention, the third rod 30 further comprises at least one resistance adjustment device (This embodiment uses 3 sets of resistance adjustment devices 31, 32, 33 for respectively connecting with the first resilient element 51, the second resilient element 52, and the third resilient element 53 correspondingly). The resistance adjustment devices 31, 32, 33 are for adjusting the position of the connecting points at which the resilient elements 51, 52, 53 connect with the third rod 30, such that the magnitude of the resistance provided by the resilient elements is adjusted, respectively. In this embodiment, the resistance adjustment devices 31, 32, 33 may be a lead screw and its corresponding components for improving the convenience of adjusting the position of each connecting point, but the resistance adjustment devices 31, 32, 33 of the present invention are not limited to a lead screw and its corresponding components.

The upper limb training device 1 of the present invention further comprises a supporting arm 70. The supporting arm 70 is pivoted to the fourth rod 40 by a fourth revolution element 64, such that the fourth revolution element 64 is able to rotate relative to the supporting arm 70. A rotation axis s4 of the fourth revolution element 64 is substantially perpendicular to ground. The supporting arm 70 is able to connect to an object, such as a pillar, a wall, a frame, a fixed object or other mechanism, for allowing the user to use the upper limb training device 1 of the present invention to do all kinds of exercises for his/her upper limb.

Figure 3:
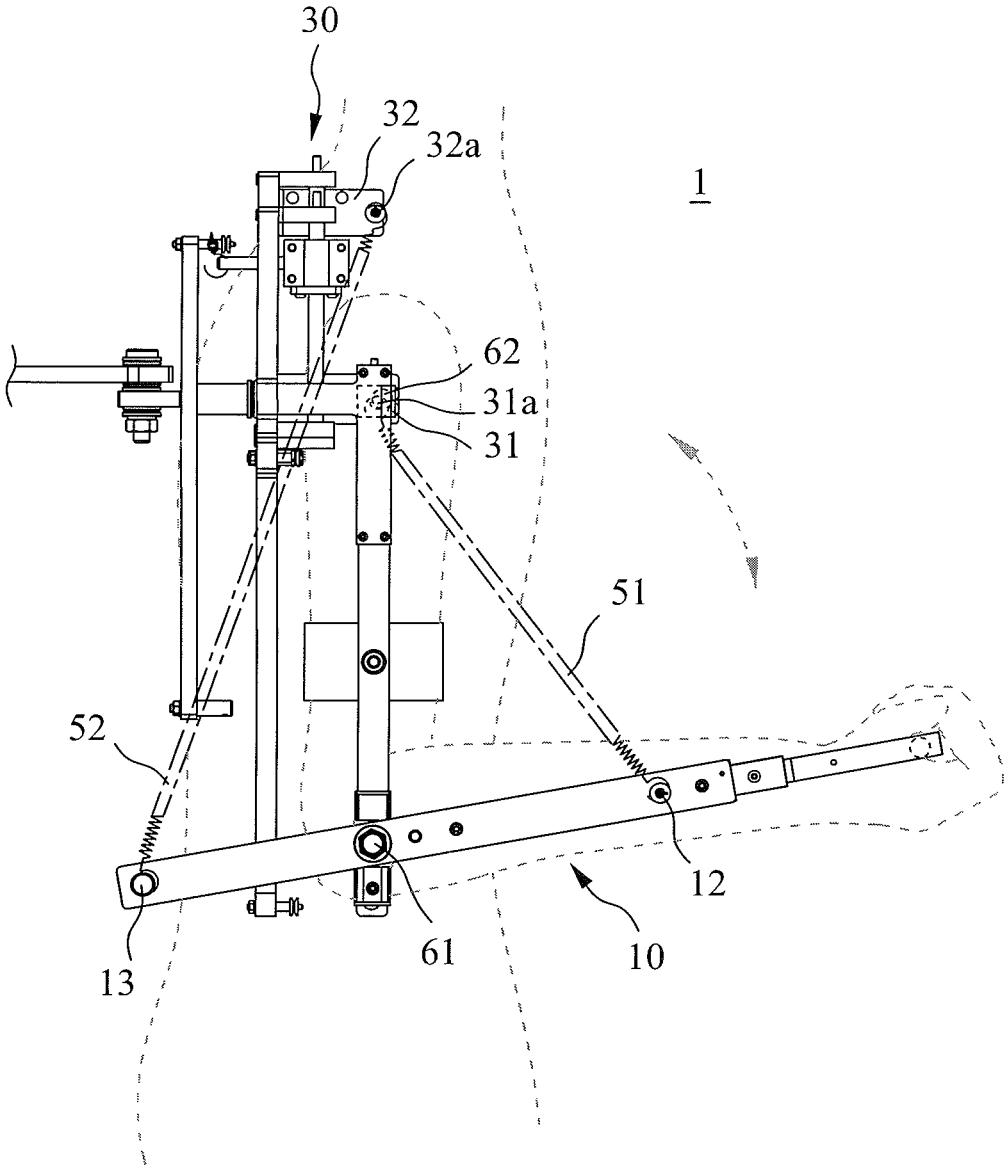
FIG. 3 is a schematic drawing of applying the upper limb training device of the present invention to an elbow flexion/extension.

Please refer to FIG. 3, which is a schematic drawing of applying the upper limb training device 1 of the present invention to an elbow flexion/extension. The upper limb training device 1 of the present invention is able to perform exercise for different muscle groups such as the upper limb by different manipulations. As shown in FIG. 3, in an operating mode of this embodiment, the upper limb training device 1 is for elbow flexion/extension. In this mode, the position of the first revolution element 61 corresponds to the user's elbow joint, and the position of the second revolution element 62 corresponds to the user's shoulder joint. When the user is performing an elbow flexion/extension, a connecting point 12 at which the first resilient element 51 connects with the first rod 10 and a connecting point 31*a* at which the first resilient element 51 connects with the third rod 30 are adjusted. The resistance adjustment device 31 is used to adjust the position of the connecting point 31*a* to be close to the shoulder joint, to reduce the influence of unnecessary resistance. The second resilient element 52 connects with the first rod 10 at the connecting point 13 and connects with the third rod 30 at the connecting point 32*a*. In this operating mode, the second resilient element 52 is the main source of resistance. Thus, adjusting the resistance adjustment device 32 changes the position of the connecting point 32*a* so that the magnitude of resistance is adjusted.

When the user is performing an elbow flexion, the first revolution element 61 is the pivot, such that the first rod 10 produces a stretch effect on the second resilient element 52 to generate resistance. Thus, the goal of building the user's upper limb is accomplished. When the user is performing an elbow extension, he/she moves against the elastic restoring force of the second resilient element 52 back to the initial state of exercise. At the same time, the first resilient element 51 is used to maintain a mass balance of the device.

Figure 4:
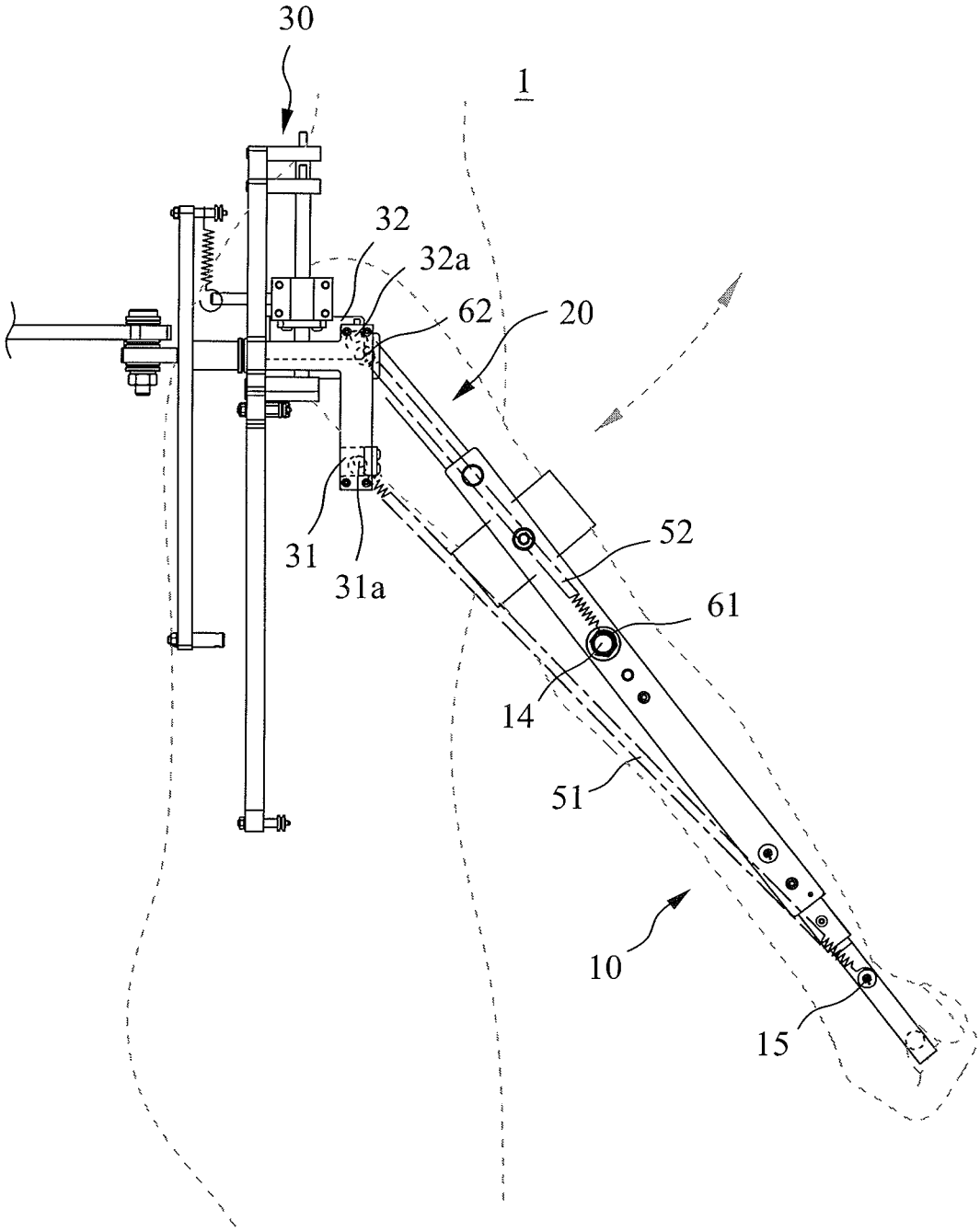
FIG. 4 is a schematic drawing of applying the upper limb training device of the present invention to a shoulder flexion/extension.

Please refer to FIG. 4, which is a schematic drawing of applying the upper limb training device 1 of the present invention to a shoulder flexion/extension. As shown in FIG. 4, in an operating mode of this embodiment, the upper limb training device 1 is for a shoulder flexion/extension. In this mode, the first resilient element 51 is connected with a connecting point 15 of the first rod 10 closest to the handle portion 11 and the connecting point 31*a* of the third rod 30. In this operating mode, the first resilient element 51 is the main source of resistance. Thus, adjusting the resistance adjustment device 31 changes the position of the connecting point 31*a*, so that the magnitude of resistance is adjusted. The second resilient element 52 is connected with the connecting point 14 (i.e., the position of the first revolution element 61) of the first rod 10 and the connecting point 32*a* of the third rod 30. The resistance adjustment device 32 is used to adjust the position of the connecting point 32*a* to be close to the shoulder joint, to reduce the influence of unnecessary resistance.

When the user is performing a shoulder flexion, the second revolution element 62 is the pivot, such that the first rod 10 produces a stretch effect on the first resilient element 51 to generate resistance. Thus, the goal of building the user's upper limb is accomplished. When the user is performing a shoulder extension, he/she moves against the elastic restoring force of the first resilient element 51 back to the initial state of exercise without the interference or influence of the second resilient element 52.

The above elbow flexion/extension and shoulder flexion/extension simply apply the linking-up operation of cooperation of the first rod 10, the second rod 20, the first resilient element 51, and the second resilient element 52, such that the exercise with a first degree of freedom of the elbow and shoulder is accomplished.

Figure 5:
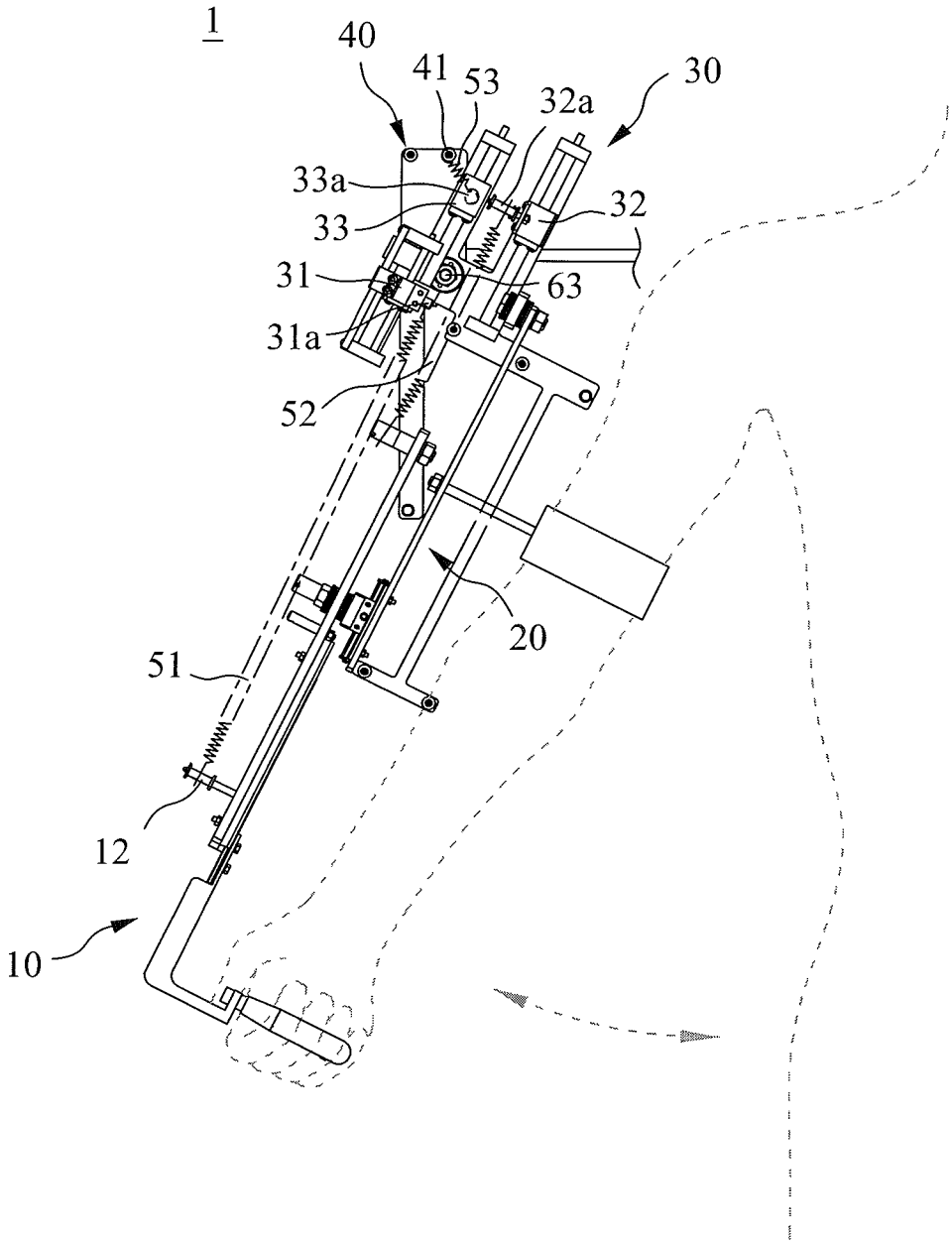
FIG. 5 is a schematic drawing of applying the upper limb training device of the present invention to a shoulder abduction/adduction.

Please refer to FIG. 5, which is a schematic drawing of applying the upper limb training device 1 of the present invention to a shoulder abduction/adduction. This operating mode is a modification of the above operating modes. As shown in FIG. 5, in an operating mode of this embodiment, the upper limb training device 1 is for a shoulder abduction/adduction. In this mode, the first resilient element 51 is connected with the connecting point 12 of the first rod 10 and the connecting point 31*a* of the third rod 30. The second resilient element 52 is connected with the connecting point 13 of the first rod 10 and the connecting point 32*a* of the third rod 30. In this operating mode, the third resilient element 53 is used. The third resilient element 53 is connected with the connecting point 33*a* of the third rod 30 and the connecting point 41 of the fourth rod 40. In this operating mode, the third resilient element 53 is the main source of resistance. Thus, adjusting the resistance adjustment device 33 changes the position of the connecting point 33*a* so that the magnitude of resistance is adjusted.

When the user is performing a shoulder abduction, the third revolution element 63 is the pivot, such that the third rod 30 produces a stretch effect on the third resilient element 53 to generate resistance. Thus, the goal of building the user's upper limb is accomplished. When the user is performing a shoulder adduction, he/she moves against the elastic restoring force of the third resilient element 53 back to the initial state of exercise.

In the above shoulder abduction/adduction, the first rod 10, the second rod 20, and the third rod 30 uses the third revolution element 63 as a pivot. They are manipulated as a whole relative to the fourth rod 40, and the third resilient element 53 provides resistance, such that the exercise with a second degree of freedom of the shoulder is accomplished.

In addition, the design of the above fourth revolution element 64 and the supporting arm 70 can also be applied. The first rod 10, the second rod 20, the third rod 30, and the fourth rod 40 use the fourth revolution element 63 as a pivot. They are manipulated as a whole relative to the supporting arm 70 such that the exercise with a third degree of freedom of a shoulder is accomplished. With the above structure, the goal of a great diversity of exercise training can be accomplished by the upper limb training device 1 of the present invention.

The upper limb training device 1 of the present invention provides the upper limb exercise with multiple degrees of freedom to train different muscle groups of the upper limb. Also, it is easy to adjust the resistance. Moreover, the upper limb training device of the present invention combines a plurality of rods, revolution elements, and resilient elements. This greatly simplifies the structure of the device and decreases the volume of the device, and it is easier for the user to carry or to use.

It is noted that the above-mentioned embodiments are only for illustration. It is intended that the present invention cover modifications and variations of this invention provided they fall within the scope of the following claims and their equivalents. Therefore, it will be apparent to those skilled in the art that various modifications and variations can be made to the structure of the present invention without departing from the scope or spirit of the invention.

What is claimed is:

1. An upper limb training device comprising:

at least one first rod;

at least one second rod pivoted to the at least one first rod by a first revolution element such that the at least one first rod is able to rotate relative to the at least one second rod, with at least one of the at least one first rod and the at least one second rod being manipulated by an arm of a user;

at least one third rod pivoted to the at least one second rod by a second revolution element such that the at least one second rod is able to rotate relative to the at least one third rod;

at least one first resilient element, with two ends of the at least one first resilient element respectively connecting with the at least one first rod and the at least one third rod, with the at least one first resilient element providing resistance when the at least one first rod and the at least one second rod rotate relative to the at least one third rod; and at least one second resilient element, with two ends of the at least one second resilient element respectively connecting with the at least one first rod and the at least one third rod, with the at least one second resilient element providing resistance when the at least one first rod rotates relative to the at least one second rod, wherein the first revolution element is disposed between two connecting points at which the at least one first resilient element and the at least one second resilient element connect with the at least one first rod.

2. The upper limb training device as claimed in claim 1, further comprising:

at least one fourth rod pivoted to the at least one third rod by a third revolution element such that the at least one third rod is able to rotate relative to the at least one fourth rod; and at least one third resilient element, with two ends of the at least one third resilient element respectively connecting with the at least one third rod and the at least one fourth rod, with the at least one third resilient element providing resistance when the at least one third rod rotates relative to the at least one fourth rod.

3. The upper limb training device as claimed in claim 1, wherein a magnitude of the resistance provided by the at least one first resilient element is adjusted by changing a position of the connecting point at which the at least one first resilient element connects with the at least one first rod or the at least one third rod.

4. The upper limb training device as claimed in claim 1, wherein a magnitude of the resistance provided by the at least one second resilient element is adjusted by changing a position of the connecting point at which the at least one second resilient element connects with the at least one first rod or the at least one third rod.

5. The upper limb training device as claimed in claim 2, wherein a magnitude of the resistance provided by the at least one third resilient element is adjusted by changing a position of a connecting point at which the at least one third resilient element connects with the at least one third rod or the at least one fourth rod.

6. The upper limb training device as claimed in claim 2, further comprising a supporting arm, with the supporting arm being pivoted to the at least one fourth rod by a fourth revolution element such that the fourth revolution element is able to rotate relatively to the supporting arm, wherein a rotation axis of the fourth revolution element is substantially perpendicular to a ground.

7. The upper limb training device as claimed in claim 2, wherein the at least one third rod further comprises at least one resistance adjustment device for adjusting the position of the connecting point at which each of the resilient elements connects with the at least one third rod such that a magnitude of the resistance provided by each of the resilient elements is adjusted.

8. The upper limb training device as claimed in claim 1, wherein the at least one first rod further comprises a handle portion for a user to grasp to manipulate the first rod.

9. The upper limb training device as claimed in claim 1, wherein the at least one second rod further comprises a fastening element connecting to the arm of the user to manipulate the second rod.

10. The upper limb training device as claimed in claim 1, wherein a rotation axis of the first revolution element and a rotation axis of the second revolution element are substantially parallel and are on the same plane.

11. The upper limb training device as claimed in claim 2, wherein a rotation axis of the second revolution element and a rotation axis of the third revolution element are substantially perpendicular to one another and intersect.

12. The upper limb training device as claimed in claim 2, wherein the at least one first resilient element, the at least one second resilient element, and the at least one third resilient element are used to maintain a mass balance of the at least one first rod, the at least one second rod, the at least one third rod, and the at least one fourth rod.

13. The upper limb training device as claimed in claim 2, wherein a magnitude of the resistance provided by the at least one first resilient element is adjusted by changing a position of the connecting point at which the at least one first resilient element connects with the at least one first rod or the at least one third rod.

14. The upper limb training device as claimed in claim 2, wherein a magnitude of the resistance provided by the at least one second resilient element is adjusted by changing a position of the connecting point at which the at least one second resilient element connects with the at least one first rod or the at least one third rod.

15. The upper limb training device as claimed in claim 2, wherein a rotation axis of the first revolution element and a rotation axis of the second revolution element are substantially parallel and are on the same plane.

16. The upper limb training device as claimed in claim 8, wherein the at least one second rod further comprises a fastening element connecting to the arm of the user to manipulate the second rod.

* * * * *